US011654688B2

(12) United States Patent
Taniguchi

(10) Patent No.: US 11,654,688 B2
(45) Date of Patent: May 23, 2023

(54) PRINTING APPARATUS, AND INK RESIDUAL AMOUNT CONTROL METHOD

(71) Applicant: SEIKO EPSON CORPORATION, Tokyo (JP)

(72) Inventor: Yusuke Taniguchi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 86 days.

(21) Appl. No.: 17/203,272

(22) Filed: Mar. 16, 2021

(65) Prior Publication Data

US 2021/0291545 A1 Sep. 23, 2021

(30) Foreign Application Priority Data

Mar. 19, 2020 (JP) ..... JP2020-048929

(51) Int. Cl.
*B41J 2/175* (2006.01)

(52) U.S. Cl.
CPC ..... *B41J 2/17566* (2013.01)

(58) Field of Classification Search
CPC ..... B41J 2/17566
See application file for complete search history.

(56) References Cited

U.S. PATENT DOCUMENTS 6,733,100 B1 * 5/2004 Fujita ..... B41J 2/17566 347/19
2005/0237357 A1 * 10/2005 Usuda ..... B41J 2/16532 347/29
2008/0007580 A1 * 1/2008 Shinada ..... B41J 2/17566 347/7
2017/0361620 A1 * 12/2017 Sawada ..... B41J 2/17566

FOREIGN PATENT DOCUMENTS

JP H06-320751 11/1994

* cited by examiner

*Primary Examiner* — Jason S Uhlenhake
(74) *Attorney, Agent, or Firm* — Workman Nydegger

(57) ABSTRACT

A printing apparatus includes a nozzle inspection unit configured to inspect nozzle clogging of a nozzle, a discharged dot count unit configured to count a number of times a discharge signal is transmitted to the nozzle, a storage unit configured to store ink residual amount-related information containing an ink consumption amount for one dot, and an ink residual amount control unit configured to calculate an ink consumption amount based on the number of times the discharge signal is transmitted counted by the discharged dot count unit and the ink consumption amount for one dot, and to update the residual amount of the ink retained in the ink retaining unit. The printing apparatus removes the nozzle determined to be clogged by the inspection of the nozzle clogging by the nozzle inspection unit from the nozzles targeted for calculating the ink consumption amount.

12 Claims, 4 Drawing Sheets

PRINTING APPARATUS, AND INK RESIDUAL AMOUNT CONTROL METHOD

The present application is based on, and claims priority from JP Application Serial Number 2020-048929, filed Mar. 19, 2020, the disclosure of which is hereby incorporated by reference herein in its entirety.

BACKGROUND

1. Technical Field

The present disclosure relates to a printing apparatus, and an ink residual amount control method.

2. Related Art

In the related art, a printing apparatus controls a residual amount of ink retained in an ink retaining unit such as an ink cartridge, and outputs a warning when an ink residual amount is reduced.

For example, an ink residual amount detection device of an inkjet printer disclosed in JP 6-320751 A, upon starting dot formation, counts up the number of times of discharging ink from an inkjet head. When the inkjet head stops after the termination of the dot formation, the ink residual amount detection device calculates an ink consumption amount by integrating an ink consumption amount for one dot and the count up number of times of discharging ink together.

Unfortunately, when ink clogging occurs in a nozzle that discharges ink, the ink is not discharged from the nozzle in which the ink clogging occurred. As a result, there is an issue in that a correct control of ink residual amount cannot be achieved.

SUMMARY

An aspect of resolving the above-described issue is a printing apparatus that includes an ink retaining unit, a head including a nozzle row formed by a plurality of nozzles arranged side by side, and configured to discharge ink from the nozzles based on image data to form an image on a printing medium, the ink being supplied from the ink retaining unit, an ink residual amount control unit configured to control a residual amount of the ink retained in the ink retaining unit, a nozzle inspection unit configured to inspect nozzle clogging of the nozzle, a discharged dot count unit configured to count a number of times a discharge signal is transmitted to the nozzle, provided that a discharge signal is transmitted to the nozzle once corresponding to one dot of the image data transmitted, and a storage unit configured to store ink residual amount-related information containing an ink consumption amount for one dot and used to calculate the residual amount of the ink retained in the ink retaining unit, in which the ink residual amount control unit is configured to calculate an ink consumption amount based on the number of times the discharge signal is transmitted counted by the discharged dot count unit and the ink consumption amount for one dot, to update the residual amount of the ink retained in the ink retaining unit, and to remove a nozzle determined to be clogged in the inspection of the nozzle clogging by the nozzle inspection unit, from nozzles for which the ink consumption amount is calculated nozzle determined to be clogged.

Another aspect of resolving the above-described issue is an ink residual amount control method for a printing apparatus configured to discharge ink supplied from an ink retaining unit from a nozzle based on image data to form an image on a printing medium, the method including a control step for controlling a residual amount of the ink retained in the ink retaining unit, and an inspection step for inspecting whether nozzle clogging occurred in the nozzle, in which the control step includes counting, provided that a discharge signal is transmitted to the nozzle once corresponding to one dot of the image data, a number of times the discharge signal is transmitted to the nozzle corresponding to one dot of the image data, calculating an ink consumption amount based on the counted number of times the discharge signal is transmitted and an ink consumption amount for one dot, updating the residual amount of the ink retained in the ink retaining unit, and removing the nozzle determined to be clogged by the inspection of the nozzle clogging by the inspection step from the nozzles targeted for calculating the ink consumption amount.

DESCRIPTION OF EXEMPLARY EMBODIMENTS

Hereinafter, embodiments of the present disclosure are described with reference to the accompanying drawings.

Figure 1:
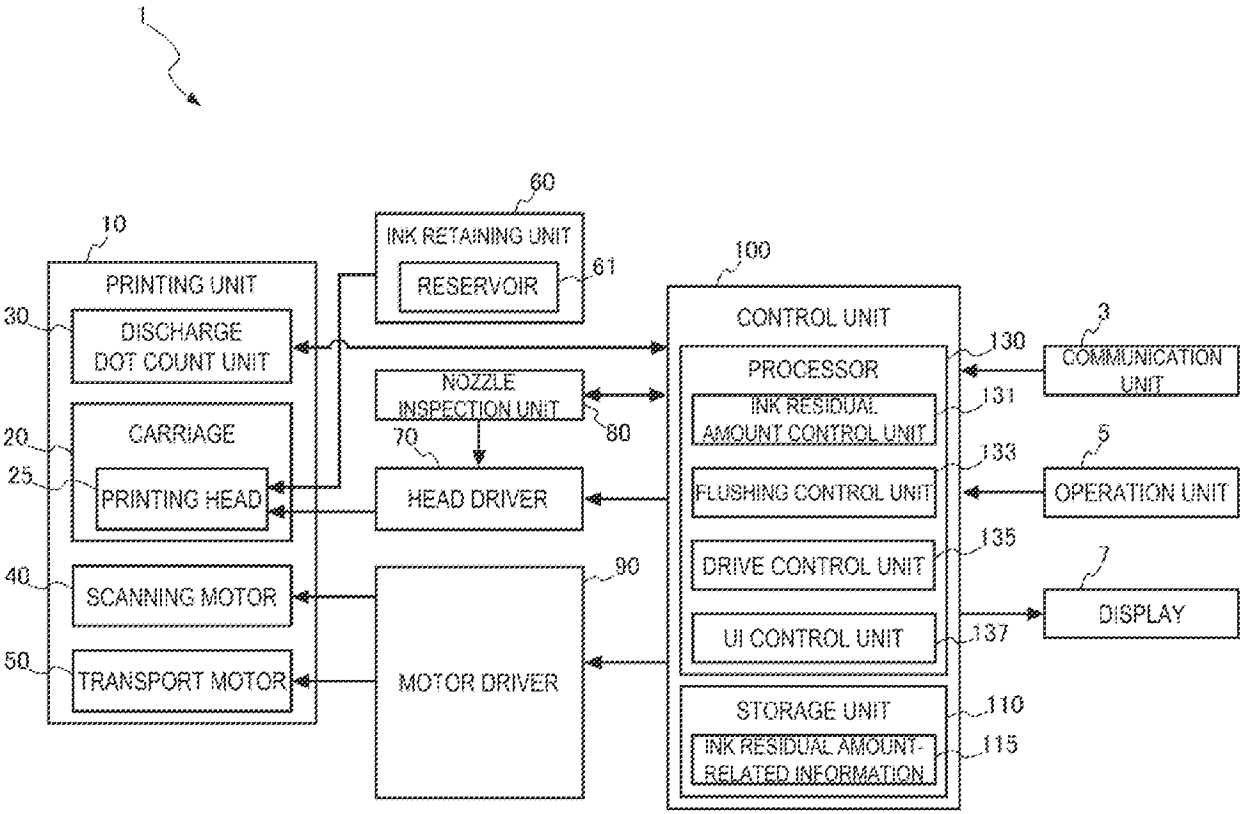
FIG. 1 is a block diagram illustrating a configuration of a printing apparatus in a first embodiment.

FIG. 1 is a block diagram illustrating a configuration of a printing apparatus 1.

The printing apparatus 1 is communicatively connected to a host computer and implements a print job received from the host computer. The print job is a group of data that include commands instructing printing on the printing apparatus 1 and data of images and texts to be printed. The printing apparatus 1 generates print data based on the received print job, and performs printing of an image based on the generated print data on a printing medium P illustrated in FIG. 2.

The printing apparatus 1 includes a communication unit 3, an operation unit 5, a display 7, a printing unit 10, an ink retaining unit 60, a head driver 70, a nozzle inspection unit 80, a motor driver 90, and a control unit 100.

The communication unit 3 executes, in accordance with a control of the control unit 100, data communication with the host computer in accordance with a predetermined communication standard, and receives the print job. The communication unit 3 outputs the received print job to the control unit 100. The control unit 100, upon being input with the print job, generates print data in a storage unit 110 based on the input print job. The control unit 100 outputs the generated print data to the head driver 70.

The operation unit 5 is an acceptance unit that accepts a user operation. The operation unit 5 includes an operation switch, an operation button, and the like, and outputs an operation signal corresponding to the operation switch and the operation button that are operated to the control unit 100.

The display 7 includes a display screen such as a liquid crystal panel, and displays various types of information in accordance with the control of the control unit 100. The display 7 corresponds to a user interface of the present disclosure.

The printing unit 10 includes a carriage 20, a discharged dot count unit 30, a scanning motor 40, and a transport motor 50.

Figure 2:
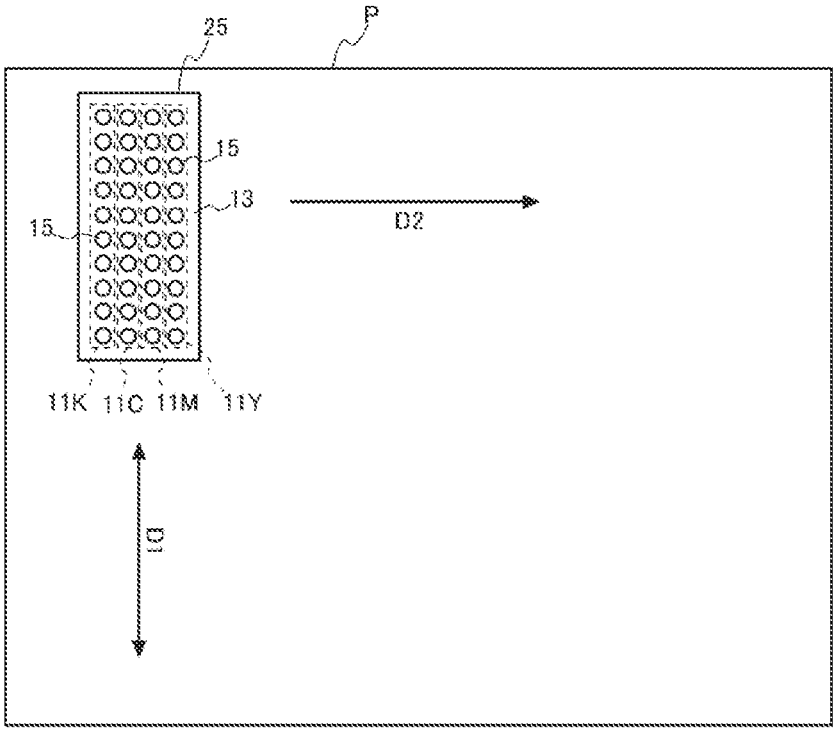
FIG. 2 is a view illustrating a configuration of a printing head.

FIG. 2 is a view schematically illustrating a nozzle face 13 of a printing head 25 and the printing medium P.

The carriage 20 is attached to a non-illustrated guide shaft extending in a main scanning direction D1 that is a width direction of the printing medium P. The carriage 20 also reciprocally moves, by a power of the scanning motor 40, in the main scanning direction D1 that is a direction in which the guide shaft extends. The printing head 25 is mounted on the carriage 20, and as the carriage 20 moves, the printing head 25 also moves in the main scanning direction D1.

In the printing head 25, four nozzle rows 11K, 11C, 11M, and 11Y in each of which a plurality of nozzles are formed side by side are arranged side by side in a sub scanning direction D2. In the first embodiment, four color inks of black, cyan, magenta, and yellow are discharged from the nozzle rows 11K, 11C, 11M, and 11Y, respectively. These four nozzle rows 11K, 11C, 11M, and 11Y are formed at the nozzle face 13 of the printing head 25. A plurality of nozzles 15 constituting the respective nozzle rows of the nozzle rows 11K, 11C, 11M, and 11Y are arranged at predetermined intervals in the main scanning direction D1.

The printing head 25 discharges, based on image data, ink supplied from the ink retaining unit 60 from the nozzles 15 to form an image on the printing medium P. The nozzle 15 included in the printing head 25 includes a discharge element such as a piezoelectric element. The discharge element allows pressure to be generated inside the nozzle 15 to cause ink inside the nozzle 15 to be discharged.

The discharged dot count unit 30 counts the number of ink droplets discharged from the nozzles 15 included in the printing head 25. Specifically, the discharged dot count unit 30 counts discharge signals output from the head driver 70 to the printing head 25, to count the number of the ink droplets discharged from each of the nozzles 15. The discharge signal is a pulse signal that drives the discharge element provided inside the nozzle 15. The head driver 70 outputs, based on the image data, the discharge signal to the nozzle 15 that discharges the ink droplets. The nozzle 15 is input with the discharge signal from the head driver 70, then the discharge element is driven to discharge the ink droplets. The discharged dot count unit 30 counts the number of times the discharge signal is input to the nozzle 15 for each of the nozzles 15 provided that the discharge signal is transmitted to the nozzle 15 once corresponding to one dot of the image data.

The scanning motor 40 drives the carriage 20 to cause the carriage 20 to scan in the main scanning direction D1. The transport motor 50 transports the printing medium P in the sub scanning direction D2.

The ink retaining unit 60 accommodates a reservoir 61 that retains ink from an ink tank, an ink cartridge, and the like. The ink retaining unit 60 supplies the ink retained in the reservoir 61 to the printing head 25. The ink supplied from the ink retaining unit 60 is four color ink of cyan, magenta, yellow, and black, for example. The ink retaining unit 60 in the first embodiment does not support ink replenishment, and the reservoir 61 accommodated in the ink retaining unit 60 is replaced when whole of the ink retained in the reservoir 61 is consumed.

The head driver 70 is input with the print data. The head driver 70 selects the nozzle 15 that discharges ink based on the input print data, and outputs the discharge signal to the selected nozzle 15.

The nozzle inspection unit 80 inspects whether nozzle clogging has occurred.

For example, the printing apparatus 1 is provided with a nozzle inspection mechanism that detects whether the nozzle clogging has occurred. The nozzle inspection mechanism includes an electrode that charges ink discharged from the nozzles 15. The nozzle inspection mechanism also includes a conductive material in which the ink discharged from the nozzles 15 lands. The nozzle inspection mechanism is also configured such that an electrical signal flowing through the conductive material is output to a predetermined signal processing circuit. Under such a configuration described above, the nozzle inspection unit 80 allows the nozzle 15 targeted to be detected whether the nozzle clogging has occurred to discharge a predetermined amount of ink particles. The discharged ink particles are charged with a predetermined amount of charge by an electrode, to land in the conductive material. In accordance with the landing of the ink particles, a state of a current in the conductive material changes, and a signal indicating an amount of the change is output to the nozzle inspection unit 80 via the predetermined signal processing circuit. When a value indicated by the input signal exceeds a predetermined threshold value, the nozzle inspection unit 80 determines that the nozzle clogging has not occurred for the nozzle on the supposition that an assumed amount of ink has been normally discharged. On the other hand, when the value indicated by the input signal falls below the predetermined threshold value, the nozzle inspection unit 80 determines that the nozzle clogging has occurred for the nozzle on the supposition that the assumed amount of ink has not been normally discharged due to some reasons.

Note that a method for detecting whether the nozzle clogging has occurred is not limited to the method described above. For example, ink may be discharged from the target nozzle 15 to form a dot, and the formed dot may be optically read to determine whether the nozzle clogging has occurred in the target nozzle 15. Also, signal waveforms of a control signal and the like that drive an actuator may be monitored to determine whether the nozzle clogging has occurred. That is, a detection of errors may be implemented using any method as long as the detection whether the nozzle clogging has occurred for each of the nozzles 15 is possible.

In addition to the nozzle clogging, the nozzle inspection unit 80 may also inspect nozzle omission that is a state where ink is not normally discharged from the nozzles 15 due to dried ink staying in the nozzle 15, contamination in the nozzle 15, or the other reasons.

The motor driver 90 drives the scanning motor 40 and the transport motor 50 in accordance with the control of the control unit 100.

The control unit 100 is a computer that includes the storage unit 110 and a processor 130. The storage unit 110 includes memories such as a ROM and a RAM, and a storage device such as an HDD or an SSD. The processor 130 is configured by a CPU or an MPU. The ROM is an abbreviation for Read Only Memory. The RAM is an abbreviation for Random Access Memory. The HDD is an abbreviation for Hard Disk Drive. The SSD is an abbreviation for Solid State Drive. The CPU is an abbreviation for Central Processing Unit. The MPU is an abbreviation for Micro-Processing Unit.

The storage unit 110 stores ink residual amount-related information 115.

The ink residual amount-related information 115 contains an ink initial value and an ink consumption amount for one dot. The ink initial value is an initial value of the ink retained in the reservoir 61. That is, the ink initial value is an amount of the ink retained in the reservoir 61 that is not yet used. In addition, the ink consumption amount for one dot indicates a weight (ng) of ink per one dot, for example. Further, the ink consumption amount for one dot indicates an average value of sizes of the ink droplets. For example, supposing that the sizes of the ink droplets discharged from the printing head 25 have three sizes that are large, medium and small, the ink consumption amount for one dot is an average value of these three ink droplets of large, medium and small.

The control unit 100 materializes various types of functional configurations by the processor 130 executing a computer program stored in the storage unit 110. The control unit 100 includes, as the functional configurations, an ink residual amount control unit 131, a flushing control unit 133, a drive control unit 135, and a UI control unit 137. When the detection whether the nozzle clogging has occurred is performed by monitoring the signal waveforms of the control signal and the like that drive the actuator, the control unit 100 may include the nozzle inspection unit 80.

The ink residual amount control unit 131 controls an ink residual amount in the reservoir 61, and updates the ink residual amount-related information 115 stored in the storage unit 110 based on the ink residual amount.

The ink residual amount control unit 131 calculates the ink residual amount in the reservoir 61 by a calculation method A described below.

The ink residual amount control unit 131 calculates, by the calculation method A, the ink residual amount in the reservoir 61 according to Formula (1) set out below.

$$\text{Ink Residual Amount} = \text{Ink Initial Value} - \text{Ink Consumption Amount per One Dot} \times \text{Cumulative Count Value of Number of Times of Discharging} \quad (1)$$

The cumulative count value of the number of times of discharging is a count value of the discharged dot count unit 30, and is a value obtained by cumulating a count value obtained by counting the number of times of discharging from a start of use of the ink in the reservoir 61 after the reservoir 61 that is not yet used is accommodated in the ink retaining unit 60, until the present time.

The ink residual amount control unit 131 also excludes a count value of the nozzles 15 determined that the nozzle clogging has occurred by the nozzle inspection unit 80 from a target for calculating an ink consumption amount. That is, the cumulative count value of the number of times of discharging in Formula (1) does not include the count value of the nozzles 15 determined that the nozzle clogging has occurred by the nozzle inspection unit 80. The ink residual amount control unit 131 subtracts the count value of the nozzles 15 determined that the nozzle clogging has occurred from the count value of all of the nozzles counted by the discharged dot count unit 30 to calculate the number of times of discharging.

The ink residual amount control unit 131 may also exclude the nozzle 15 determined that the nozzle clogging has occurred by the nozzle inspection unit 80 from a target for counting the discharge signals by the discharged dot count unit 30. The ink residual amount control unit 131 notifies the discharged dot count unit 30 of information about the nozzle 15 determined that the nozzle clogging has occurred. The discharged dot count unit 30 does not count the discharge signal input to the nozzle 15 notified from the ink residual amount control unit 131.

In addition, the method for calculating the ink residual amount may be a calculation method B or C described below.

In the calculation method B, the ink initial value, the ink consumption amount for one dot, and a cumulative ink discharge amount are stored as the ink residual amount-related information 115 in the storage unit 110. The cumulative ink discharge amount is a value calculated by the ink residual amount control unit 131, and is calculated by the Formula (2) set out below.

$$\text{Cumulative Ink Discharge Amount} = \text{Ink Consumption Amount per One Dot} \times \text{Cumulative Count Value of Number of times of Discharging} \quad (2)$$

The ink residual amount control unit 131 allows the storage unit 110 to store the calculated cumulative ink discharge amount as the ink residual amount-related information 115.

As described above, the cumulative count value of the number of times of discharging is a value obtained by cumulating the count value obtained by counting the number of times of discharging from the start of use of the ink in the reservoir 61, until the present time. Also, as in the calculation method A, the cumulative count value of the number of times of discharging does not include the count value of the nozzles 15 determined that the nozzle clogging has occurred by the nozzle inspection unit 80. The ink residual amount control unit 131 subtracts the count value of the nozzles 15 determined that the nozzle clogging has occurred from the count value of all of the nozzles counted by the discharged dot count unit 30 to calculate the number of times of discharging.

The ink residual amount control unit 131 calculates the ink residual amount based on the ink residual amount-related information 115 stored in the storage unit 110. The ink residual amount control unit 131 subtracts the cumulative ink discharge amount from the ink initial value to calculate the ink residual amount in the reservoir 61.

That is, the ink residual amount is calculated, by the calculation method B, according to Formula (3) set out below.

$$\text{Ink Residual Amount} = \text{Ink Initial Value} - \text{Cumulative Ink Discharge Amount} \quad (3)$$

This calculation method B may also be a modified example described below. In this modified example, a differential ink discharge amount that is a cumulative ink discharge amount from the previous update time is stored as the ink residual amount-related information 115 in the storage unit 110. The update time is an update time of updating the ink residual amount displayed on a display screen of the display 7. In the modified example of the calculation method B, the count value of the discharged dot count unit 30 is reset when updating the ink residual amount displayed on the display screen. First, the ink residual amount control unit 131 calculates a differential ink discharge amount. The differential ink discharge amount is calculated according to Formula (4) set out below.

$$\text{Differential Ink Discharge Amount} = \text{Ink Consumption Amount per One Dot} \times \text{Count Value of Number of times of Discharging} \quad (4)$$

In the above-described Formula (4), the count value of the number of times of discharging is a count value from the time after resetting the discharged dot count unit 30, until the present time. Also, as in the calculation method A, the count value of the number of times of discharging does not include the count value of the nozzles 15 determined that the nozzle clogging has occurred by the nozzle inspection unit 80. The ink residual amount control unit 131 subtracts the count value of the nozzles 15 determined that the nozzle clogging has occurred from the count value of all of the nozzles counted by the discharged dot count unit 30 to calculate the number of times of discharging.

In addition, in this modified example, the ink residual amount control unit 131 calculates the cumulative ink discharge amount according to Formula (5) set out below.

Cumulative Ink Discharge Amount=Cumulative Ink Discharge Amount at Previous Update Time+Differential Ink Discharge Amount (5)

The cumulative ink discharge amount at the previous update time is the ink residual amount-related information 115 that is stored as the cumulative ink discharge amount in the storage unit 110. Further, the differential ink discharge amount is a value that is calculated by Formula (4).

In this modified example, the ink residual amount control unit 131 calculates the ink residual amount according to Formula (6) set out below.

Ink Residual Amount=Ink Initial Value−Cumulative Ink Discharge Amount at Previous Update time−Differential Ink Discharge Amount (6)

In the calculation method C, the ink residual amount and the ink consumption amount for one dot are stored as the ink residual amount-related information 115 in the storage unit 110. The ink residual amount is an ink residual amount calculated by the ink residual amount control unit 131, and the ink residual amount is an ink initial value when the reservoir 61 is not used.

The ink residual amount control unit 131 calculates the ink residual amount according to Formula (7) set out below.

Ink Residual Amount=Ink Residual Amount at Previous Update Time−Ink Consumption Amount per One Dot×Count Value of Number of times of Discharging (7)

In the calculation method C as well, the count value of the discharged dot count unit 30 is reset when updating the ink residual amount displayed on the display screen. Thus, the count value of the number of times of discharging is a count value from the time of resetting the count value of the discharged dot count unit 30, until the present time. Also, as in the calculation method A, the count value of the number of times of discharging does not include the count value of the nozzles 15 determined that the nozzle clogging has occurred by the nozzle inspection unit 80. The ink residual amount control unit 131 subtracts the count value of the nozzles 15 determined that the nozzle clogging has occurred from the count value of all of the nozzles counted by the discharged dot count unit 30 to calculate the number of times of discharging.

The flushing control unit 133 implements a flushing operation every time a predetermined period of time has elapsed or every time an implementation of a preset operation has been completed. The flushing operation is performed to prevent clogging in the nozzle 15 of the printing head 25. In the flushing operation, the flushing control unit 133 drives the printing head 25 to discharge a predetermined amount of ink from the nozzles 15 of the printing head 25. Also, the preset operation includes a receiving operation of the print job and a printing operation. The flushing control unit 133, upon receiving the print job, implements the flushing operation before a start of printing. The flushing control unit 133, upon completion of the printing of an image by a preset amount of one page, one row, or the like, also implements the flushing operation.

When the flushing control unit 133 executes the flushing operation, the ink residual amount control unit 131 causes the nozzle inspection unit 80 to implement the nozzle inspection to detect the nozzle 15 in which the ink clogging has occurred. Subsequently, when the printing is started, the ink residual amount control unit 131 subtracts the count value of the nozzles 15 determined that the nozzle clogging has occurred from the count value of all of the nozzles counted by the discharged dot count unit 30 to calculate the number of times of discharging. The ink residual amount control unit 131 then calculates the ink residual amount according to any one of the calculation methods A, B, and C described above.

In addition, when the nozzle 15 in which the nozzle clogging had occurred is determined that the nozzle clogging has not occurred by the nozzle inspection after the flushing operation, the ink residual amount control unit 131 adds the nozzle 15 in which the nozzle clogging has been resolved to a target for counting the number of times of discharging. The ink residual amount control unit 131 adds the nozzle 15 in which the nozzle clogging has been resolved to the target for counting the number of times of discharging.

The drive control unit 135 controls the head driver 70 to allow the printing head 25 to operate. The drive control unit 135 also controls the motor driver 90 to allow the scanning motor 40 and the transport motor 50 to operate.

The UI control unit 137 allows the display screen of the display 7 to display the ink residual amount calculated by the ink residual amount control unit 131. The UI control unit 137 also updates the ink residual amount displayed on the display screen of the display 7 every time a printing of an image by an amount of one row, an amount of a plurality of rows, or an amount of one page is completed. The UI control unit 137 may also update the ink residual amount displayed on the display screen of the display 7 when an operation instructing display of the ink residual amount is accepted by the operation unit 5, or when the ink residual amount that has been detected becomes not greater than a preset amount of ½, ¼, or the like, or may update the ink residual amount in real time.

Figure 3:
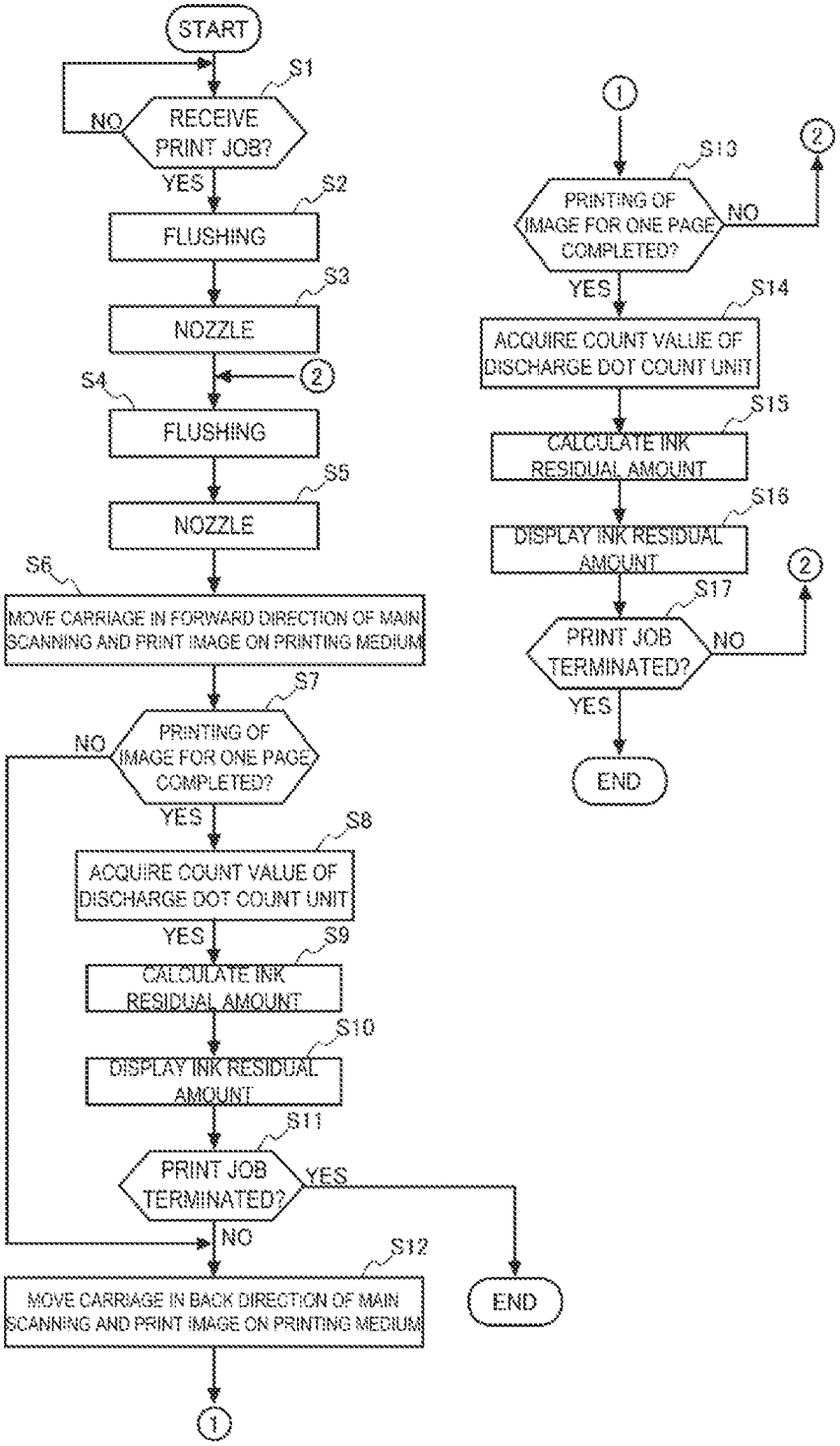
FIG. 3 is a flowchart illustrating an operation of a printing apparatus.

FIG. 3 is a flowchart illustrating an operation of the control unit 100.

The operation of the control unit 100 will be described with reference to the flowchart illustrated in FIG. 3.

First, the control unit 100 determines whether the print job has been received from the host computer (step S1). The control unit 100, when not receiving the print job (step S1/NO), waits for a start of the process until receiving the print job. Alternatively, the control unit 100, when receiving the print job (step S1/YES), causes the flushing operation to be implemented before printing is started, and causes the nozzle inspection unit 80 to inspect the nozzle clogging (step S3).

The control unit 100 also implements the flushing operation (step S4) and an inspection of the nozzle clogging (step S5) before moving the carriage 20 in the main scanning direction to perform printing. The control unit 100 implements the flushing operation (step S4) and the inspection of the nozzle clogging (step S5) every time an image for one reciprocating operation is printed.

The control unit 100, after implementing the flushing operation (step S4) and the inspection of the nozzle clogging (step S5), moves the carriage 20 in the forward direction of the main scanning and causes the printing medium P to print an image (step S6).

Next, the control unit 100 determines whether the printing of the image by the amount of one page has been completed (step S7). When the printing of the image by the amount of one page has not been completed (step S7/NO), the control unit 100 proceeds to a processing of step S12.

Alternatively, when the printing of the image by the amount of one page has been completed (step S7/YES), the control unit 100 acquires the number of times the discharge signal is transmitted counted by the discharged dot count unit 30 (step S8). The control unit 100 also subtracts the count value of the nozzles 15 determined that the nozzle clogging has occurred in the inspection of step S5 from the number of times the discharge signal is transmitted. The control unit 100 then calculates, in accordance with Formula (1) described above, an integrated value by integrating the cumulative count value of the number of times of discharging and the ink consumption amount for one dot together, and subtracts the calculated integrated value from the ink initial value to calculate the ink residual amount (step S9). The control unit 100 allows the display 7 to display the calculated ink residual amount (step S10).

Next, the control unit 100 determines whether the print job has been terminated (step S11). When the print job has been terminated (step S11/YES), the control unit 100 terminates this process flow. Alternatively, when the print job has not been terminated (step S11/NO), the control unit 100 proceeds to the processing of step S12. Further, in step S7, the control unit 100, when determining that the printing of the image by the amount of one page has not been completed (step S7/NO), also proceeds to the processing of step S12.

In step S12, the control unit 100 moves the carriage 20 in the back direction of the main scanning, and causes the printing medium P to print an image (step S12). The control unit 100 then determines whether the printing of the image by the amount of one page has been completed (step S13). When the printing of the image by the amount of one page has been completed (step S13/YES), the control unit 100 acquires the number of times the discharge signal is transmitted counted by the discharged dot count unit 30 (step S14).

The control unit 100 subtracts the count value of the nozzles 15 determined that the nozzle clogging has occurred in the inspection of step S5 from the number of times the discharge signal is transmitted acquired in step S14 to calculate the ink residual amount in accordance with Formula (1) described above (step S15). The control unit 100 allows the display 7 to display the calculated ink residual amount (step S16). Subsequently, the control unit 100 determines whether the print job has been terminated.

When the print job has not been terminated (step S17/NO), or when the printing of the image by the amount of one page has not been completed in step S13 (step S13/NO), the control unit 100 proceeds to a processing of step S4 to implement the flushing operation.

Alternatively, when the print job has been terminated (step S17/YES), the control unit 100 terminates this process flow.

In the flowchart described above, steps S8 and S9, steps S14 and S15 correspond to the control steps of the present disclosure. Further, steps S3 and S5 correspond to the inspection steps of the present disclosure.

As described above, the printing apparatus 1 in the first embodiment includes the ink retaining unit 60, the printing head 25, the ink residual amount control unit 131, the nozzle inspection unit 80, and the storage unit 110.

The printing head 25 includes a nozzle row 11 in which the plurality of nozzles 15 are formed side by side, and is configured to discharge, from the nozzles 15, the ink supplied from the ink retaining unit 60 based on the image data to form an image on the printing medium P.

The ink residual amount control unit 131 is configured to control a residual amount of the ink retained in the ink retaining unit 60.

The nozzle inspection unit 80 is configured to inspect nozzle clogging of the nozzle 15.

The discharged dot count unit 30 is configured to count the number of times the discharge signal is transmitted to the nozzle 15, provided that the discharge signal is transmitted to the nozzle 15 once corresponding to one dot of the image data.

The storage unit 110 is configured to store the ink residual amount-related information 115 containing the ink consumption amount for one dot and used to calculate the residual amount of the ink retained in the ink retaining unit 60.

The ink residual amount control unit 131 is configured to calculate the ink consumption amount based on the number of times the discharge signal is transmitted counted by the discharged dot count unit 30 and the ink consumption amount for one dot, and to update the residual amount of the ink retained in the ink retaining unit 60.

The ink residual amount control unit 131 is also configured to remove the nozzle 15 determined that the nozzle clogging has occurred by the inspection of the nozzle clogging by the nozzle inspection unit from the nozzles 15 targeted for calculating the ink consumption amount.

This makes it possible to enhance an accuracy of calculating the ink consumption amount, and to more accurately control the ink residual amount of the ink retaining unit 60.

The discharged dot count unit 30 is configured, when the nozzle inspection unit 80 inspects the nozzle clogging, to count the number of times the discharge signal is transmitted, excluding the nozzle 15 determined that the nozzle clogging has occurred by the inspection of the nozzle clogging from the nozzles 15 targeted for counting the number of times of the discharge signals.

This makes it possible to accurately calculate the number of times of the discharge signals with which the ink has been consumed, enhancing the accuracy of calculating the ink consumption amount.

The ink residual amount control unit 131 is configured to subtract the number of times of the discharge signals transmitted to the nozzle determined that the nozzle clogging has occurred from the number of times the discharge signal is transmitted counted by the discharged dot count unit 30 to calculate the number of times the discharge signal is transmitted.

This makes it possible to accurately calculate the number of times of the discharge signals with which the ink has been consumed, enhancing the accuracy of calculating the ink consumption amount.

The discharged dot count unit 30 is configured, when the nozzle 15 determined that the nozzle clogging has occurred by the nozzle inspection unit 80 and excluded from a target for counting the discharge signals is determined that the nozzle clogging has not occurred by the nozzle inspection unit 80, to add the nozzle 15 to the target for counting the discharge signals.

Thus, even the nozzle 15 once determined that the nozzle clogging has occurred is added to the target for counting the discharge signals when the nozzle clogging is resolved, thus making it possible to accurately calculate the number of times of the discharge signals with which the ink has been consumed. This makes it possible to enhance the accuracy of calculating the ink consumption amount.

The nozzle inspection unit 80 is configured to inspect the nozzle clogging before printing is started.

This makes it possible to enhance the accuracy of determining the nozzle 15 that cannot be used in printing.

The printing apparatus 1 also includes the flushing control unit 133 configured to cause the printing head 25 to discharge the ink to execute flushing processing of the head.

The nozzle inspection unit 80 is configured to inspect the nozzle clogging every time the flushing control unit 133 executes the flushing processing.

This makes it possible to detect the nozzle 15 in which the nozzle clogging has been resolved by flushing.

The printing apparatus 1 includes the display 7 configured to display the residual amount of the ink retained in the ink retaining unit 60, and the UI control unit 137 configured to update display information of the display 7 based on the ink residual amount-related information 115.

The UI control unit 137 is configured to update the display information of the display 7 every time printing for one page is completed.

This enables the display 7 to display a ink residual amount at every time the printing for one page is completed.

The ink residual amount-related information 115 contains information indicating the residual amount of the ink retained in the ink retaining unit 60. The ink residual amount control unit 131 is configured to subtract the ink consumption amount calculated based on the number of times the discharge signal is transmitted counted by the discharged dot count unit 30 and the ink consumption amount for one dot, from the residual amount of the ink retained in the ink retaining unit 60 indicated by the ink residual amount-related information 115, and to update the residual amount of the ink retained in the ink retaining unit 60.

This makes it possible to accurately calculate the ink consumption amount by a simple operation, to update the ink residual amount.

The ink residual amount-related information 115 also contains an initial value of an amount of the ink retained in the ink retaining unit 60, and a cumulative value of the ink consumption amount from a start of use of the ink retaining unit 60.

The ink residual amount control unit 131 is configured to add the ink consumption amount calculated based on the number of times the discharge signal is transmitted counted by the discharged dot count unit 30 and the ink consumption amount for one dot, and to the cumulative value of the ink consumption amount from the start of use of the ink retaining unit 60. This makes it possible to update the cumulative value of the ink consumption amount from the start of use of the ink retaining unit 60.

The ink residual amount control unit 131 is also configured to subtract the updated cumulative value of the ink consumption amount from the start of use of the updated ink retaining unit 60 from the initial value of the amount of the ink retained in the ink retaining unit 60, and to update the residual amount of the ink retained in the ink retaining unit 60.

This makes it possible to accurately calculate the ink consumption amount by a simple operation, to update the ink residual amount.

The ink residual amount-related information 115 further contains the initial value of the amount of the ink retained in the ink retaining unit 60.

The ink residual amount control unit 131 is configured to subtract the ink consumption amount calculated based on the number of times the discharge signal is transmitted counted by the discharged dot count unit 30 and the ink consumption amount for one dot, from the initial value of the amount of the ink retained in the ink retaining unit 60 indicated by the ink residual amount-related information 115, and to update the residual amount of the ink retained in the ink retaining unit 60.

This makes it possible to accurately calculate the ink consumption amount by a simple operation, to update the ink residual amount.

Second Embodiment

The second embodiment of the present disclosure is described below with reference to the accompanying drawings.

Figure 4:
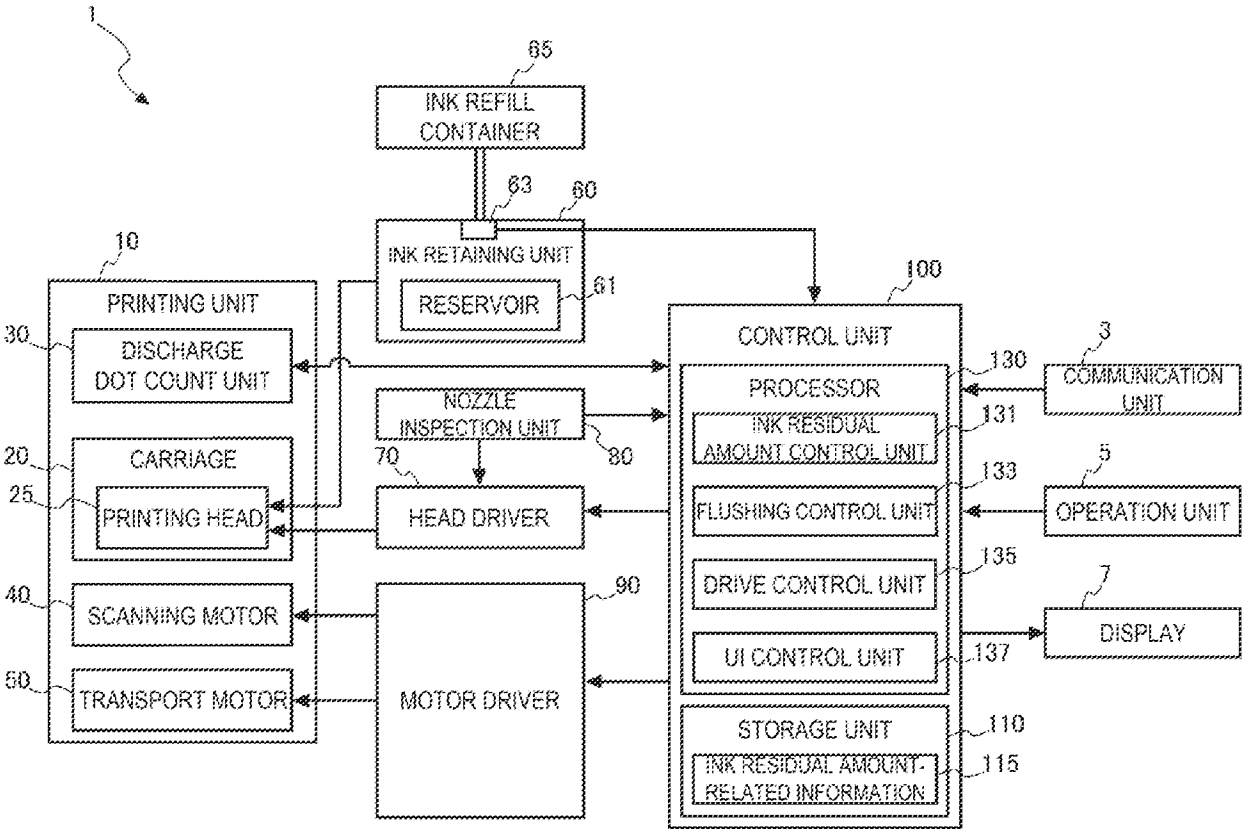
FIG. 4 is a block diagram illustrating a configuration of a printing apparatus in a second embodiment.

FIG. 4 is a block diagram illustrating a configuration in the second embodiment.

The second embodiment is configured to refill the ink in the reservoir 61 of the ink retaining unit 60, and the other configurations are the same as those in the first embodiment.

The ink retaining unit 60 in the second embodiment includes a refill port to which an ink refill container 65 can be coupled. The ink refill container 65 is coupled to the refill port so that the ink filled inside the ink refill container 65 is refilled in the reservoir 61 of the ink retaining unit 60. When the ink refill container 65 is used to refill the ink in the reservoir 61, the ink is refilled so that an ink amount in the reservoir 61 becomes fully filled.

As in the first embodiment, the storage unit 110 in the second embodiment stores the ink initial value and the ink consumption amount for one dot as the ink residual amount-related information 115, where the ink initial value in the second embodiment indicates an ink amount when the ink amount in the reservoir 61 is fully filled.

The ink residual amount control unit 131 in the second embodiment also calculates the ink residual amount by the calculation method A described in the first embodiment. When the reservoir 61 is refilled with the ink, the control unit 100 resets the count value of the discharged dot count unit 30, and changes the ink initial value to the ink amount when the reservoir 61 is fully filled.

The ink residual amount control unit 131 in the second embodiment can also calculate the ink residual amount by the calculation method B described in the first embodiment. In this case as well, when the ink refill container 65 is used to refill the ink retaining unit 60, the ink is refilled so that the ink amount in the reservoir 61 becomes fully filled.

In the calculation method B, the information stored as the ink residual amount-related information 115 in the storage unit 110 contains the ink initial value, the ink consumption amount for one dot, and the cumulative ink discharge amount. The ink residual amount control unit 131 resets the cumulative ink discharge amount and the count value of the discharged dot count unit 30 when the ink has been refilled in the ink retaining unit 60. In addition, the control unit 100 changes the ink initial value to the ink amount when the reservoir 61 is fully filled.

The ink residual amount control unit 131 in the second embodiment can also calculate the ink residual amount by the calculation method C described above. In this case as well, when the ink refill container 65 is used to fill the ink retaining unit 60, the ink is refilled so that the ink amount in the reservoir 61 becomes fully filled.

When the ink is refilled in the ink retaining unit 60, the control unit 100 resets the count value of the discharged dot count unit 30 stored as the ink residual amount-related information 115 in the storage unit 110. The control unit 100 also changes the ink residual amount stored as the ink residual amount-related information 115 in the storage unit 110 to the ink amount when the reservoir 61 is fully filled.

Also, when the ink refill container 65 is used to refill the ink, the amount of the ink to be refilled may be optionally changed. In this case, an ink refill port of the ink retaining unit 60 is provided with a detection unit 63 configured to detect a refill amount of the ink refilled from the ink refill container 65, to thus detect an amount of the ink refilled by the detection unit 63. The detection unit 63 is configured to detect a refilled ink amount based on a coupling time during which the ink refill container 65 is coupled to the refill port, for example. The detection unit 63 may also include a rotation body at a flow path coupling the ink refill container 65 with the ink retaining unit 60, and may be configured to detect a rotation amount of the rotation body to detect the refilled ink amount. Alternatively, the ink retaining unit 60 may not be provided with the detection unit 63 or the like, and the user may operate the operation unit 5 to input the ink amount that has been refilled in the ink retaining unit 60. Further, a timing of refilling the ink to the ink retaining unit 60 includes various timings, such as a timing when the printing apparatus 1 waits for printing or when the ink residual amount becomes zero during printing. The detection unit 63 corresponds to a refill amount acquisition unit of the present disclosure.

For example, when the ink residual amount is calculated by the calculation method C, the control unit 100, when detecting that the ink residual amount becomes zero, allows the display 7 to display a guide notifying that the ink residual amount becomes zero. The control unit 100 also changes the ink residual amount stored as the ink residual amount-related information 115 in the storage unit 110 to zero. Subsequently, when the ink refill container 65 is used to refill the ink, the control unit 100 adds the refilled ink amount to the ink residual amount stored in the storage unit 110, and stores the calculated value in the storage unit 110.

Thus, even when the ink is refilled in the ink retaining unit 60, the residual amount of the ink retained in the ink retaining unit 60 can be calculated with high accuracy.

Each of the embodiments described above merely illustrates a specific example to which the present disclosure is applied. The present disclosure is not limited to the configurations in the embodiments described above, and can be implemented in various aspects without departing from the gist of the disclosure.

For example, in the flowchart illustrated in FIG. 3, the ink residual amount is displayed on the display 7 at a timing at which the printing of the image for one page is completed, and the ink residual amount is updated as well. In addition, the timing of the display and the update of the ink residual amount may also be a timing at which one print job is terminated, or a timing at which the ink residual amount is reduced to an amount not greater than a preset amount after an operation of powering off a power source is input, immediately after the printing apparatus 1 is powered on, for example.

For example, each of the components of the printing apparatus 1 illustrated in FIG. 1 is an example, and specific implementation aspects are not particularly limited. That is, hardware that individually corresponds to each of the components is not necessarily implemented, and a configuration is possible as a matter of course in which a single processor executes a program to enable function of each of the components. In addition, in the above-described embodiments, some of the functions enabled by software may be enabled by hardware, or some of the functions enabled by the hardware may be enabled by the software.

Further, a step unit in the flowchart illustrated in FIG. 4 is obtained by dividing processing in accordance with a main processing content in order to facilitate the understanding of the operations of the printing apparatus 1. Thus, the present disclosure is not limited by a method for dividing the processing into processing units and a name. The processing may be divided into more step units depending on a processing content. Also, one step unit may be divided so as to contain furthermore processings. Further, the order of the steps may be transposed as appropriate in a range where the gist of the present disclosure is not hindered.

What is claimed is:

1. A printing apparatus, comprising:

an ink retaining unit;

a head including a nozzle row formed by a plurality of nozzles arranged side by side, and configured to discharge ink from the nozzles based on image data to form an image on a printing medium, the ink being supplied from the ink retaining unit;

an ink residual amount control unit configured to control a residual amount of the ink retained in the ink retaining unit, a nozzle inspection unit configured to inspect nozzle clogging of the nozzle, a discharged dot count unit configured to count a number of times a discharge signal is transmitted to the nozzle, provided that a discharge signal is transmitted to the nozzle once corresponding to one dot of the image data; and a storage unit configured to store ink residual amount-related information containing an ink consumption amount for one dot and used to calculate the residual amount of the ink retained in the ink retaining unit, wherein the ink residual amount control unit is configured to calculate an ink consumption amount based on the number of times the discharge signal is transmitted counted by the discharged dot count unit and the ink consumption amount for one dot and update the residual amount of the ink retained in the ink retaining unit, and to remove a nozzle determined to be clogged in the inspection of the nozzle clogging by the nozzle inspection unit, from nozzles for which the ink consumption amount is calculated so that the removed nozzle is not part of the calculated ink consumption amount.

2. The printing apparatus according to claim 1, wherein the discharged dot count unit is configured, when the nozzle inspection unit inspects the nozzle clogging, to count the number of times the discharge signal is transmitted, excluding a nozzle determined to be clogged from nozzles for which the number of times the discharge signal is transmitted is calculated.

3. The printing apparatus according to claim 2, wherein when the nozzle determined to be clogged by the nozzle inspection unit and excluded from the nozzles for which the discharge signal is counted is determined to be not clogged by the nozzle inspection unit, the discharged dot count unit adds the nozzle to the nozzles for which the discharge signal is counted.

4. The printing apparatus according to claim 1, wherein the ink residual amount control unit is configured to calculate the number of times the discharge signal is transmitted by subtracting the number of times the discharge signal is transmitted to the nozzle determined to be clogged, from the number of times the discharge signal is transmitted counted by the discharged dot count unit.

5. The printing apparatus according to claim 1, wherein the nozzle inspection unit is configured to inspect the nozzle clogging before printing is started.

6. The printing apparatus according to claim 1, comprising a flushing control unit configured to cause the head to discharge the ink to execute flushing processing of the head, wherein the nozzle inspection unit is configured to inspect the nozzle clogging every time the flushing control unit executes the flushing processing.

7. The printing apparatus according to claim 1, comprising a user interface configured to display the residual amount of the ink retained in the ink retaining unit, and a UI control unit configured to update the user interface based on the ink residual amount-related information, wherein the UI control unit is configured to update the user interface every time printing for one page is completed.

8. The printing apparatus according to claim 1, wherein the ink residual amount-related information further contains information indicating the residual amount of the ink retained in the ink retaining unit, and the ink residual amount control unit is configured to subtract the ink consumption amount calculated based on the number of times the discharge signal is transmitted counted by the discharged dot count unit and the ink consumption amount for one dot, from the residual amount of the ink retained in the ink retaining unit indicated by the ink residual amount-related information, thereby updating the residual amount of the ink retained in the ink retaining unit.

9. The printing apparatus according to claim 8, wherein the ink retaining unit is configured to be refilled with the ink, and further includes a refill amount acquisition unit configured to acquire an amount of the ink refilled in the ink retaining unit, and the ink residual amount control unit is configured, when the ink is refilled in the ink retaining unit, to add an ink amount acquired by the refill amount acquisition unit to the residual amount of the ink retained in the ink retaining unit, the residual amount being indicated by the ink residual amount-related information.

10. The printing apparatus according to claim 1, wherein the ink residual amount-related information further contains an initial value of an amount of the ink retained in the ink retaining unit, and a cumulative value of an ink consumption amount from a start of use of the ink retaining unit, and the ink residual amount control unit is configured to update the cumulative value of the ink consumption amount from the start of use of the ink retaining unit by adding the ink consumption amount calculated based on the number of times the discharge signal is transmitted counted by the discharged dot count unit and the ink consumption amount for one dot, to the cumulative value of the ink consumption amount from the start of use of the ink retaining unit, and to update the residual amount of the ink retained in the ink retaining unit by subtracting the updated cumulative value of the ink consumption amount from the start of use of the ink retaining unit, from the initial value of the amount of the ink retained in the ink retaining unit.

11. The printing apparatus according to claim 1, wherein the ink residual amount-related information further contains an initial value of an amount of the ink retained in the ink retaining unit, and the ink residual amount control unit is configured to update the residual amount of the ink retained in the ink retaining unit by subtracting the ink consumption amount calculated based on the number of times the discharge signal is transmitted counted by the discharged dot count unit and the ink consumption amount for one dot, from the initial value of the amount of the ink retained in the ink retaining unit indicated by the ink residual amount-related information.

12. An ink residual amount control method for a printing apparatus configured to discharge ink from a nozzle based on image data to form an image on a printing medium, the ink being supplied from an ink retaining unit, the method comprising:

a control step for controlling a residual amount of the ink retained in the ink retaining unit; and an inspection step for inspecting whether nozzle clogging occurred in the nozzle, wherein the control step includes counting a number of times a discharge signal is transmitted to the nozzle corresponding to one dot of the image data, provided that the discharge signal is transmitted to the nozzle once corresponding to one dot of the image data, calculating an ink consumption amount based on the counted number of times the discharge signal is transmitted and an ink consumption amount for one dot and updating the residual amount of the ink retained in the ink retaining unit, and removing the nozzle determined to be clogged in the inspection of the nozzle clogging in the inspection step, from the nozzles for which the ink consumption amount is calculated so that the removed nozzle is not part of the calculated ink consumption amount.

* * * * *